US008597069B2

(12) United States Patent
Glickman

(10) Patent No.: US 8,597,069 B2
(45) Date of Patent: Dec. 3, 2013

(54) TOY RACE TRACK SYSTEM

(75) Inventor: Joel I. Glickman, Jupiter, FL (US)

(73) Assignee: K'NEX Limited Partnership Group, Hatfield, PA (US)

( * ) Notice: Subject to any disclaimer, the term of this patent is extended or adjusted under 35 U.S.C. 154(b) by 253 days.

(21) Appl. No.: 13/208,124

(22) Filed: Aug. 11, 2011

(65) Prior Publication Data

US 2012/0088430 A1 Apr. 12, 2012

Related U.S. Application Data

(60) Provisional application No. 61/391,455, filed on Oct. 8, 2010.

(51) Int. Cl.
*A63H 18/00* (2006.01)

(52) U.S. Cl.
USPC ..... 446/444; 446/168; 446/85; 238/10 A; 238/10 R; 238/10 E; 238/10 F

(58) Field of Classification Search
USPC .... 238/10 R, 10 A, 10 E, 10 F; 273/241, 275, 273/276, 283; 446/444, 168, 85
See application file for complete search history.

(56) References Cited

U.S. PATENT DOCUMENTS

| | | | | | |
|---|---|---|---|---|---|
| 731,309 | A | * | 6/1903 | Kilbourn | 446/103 |
| 1,079,245 | A | * | 11/1913 | Hornby | 446/113 |
| 1,544,555 | A | * | 7/1925 | Chase | 104/54 |
| 2,106,424 | A | * | 1/1938 | Einfalt | 246/117 |
| 2,401,468 | A | * | 6/1946 | Duffy | 238/10 R |
| 2,827,299 | A | * | 3/1958 | Dean | 473/158 |
| 3,206,122 | A | | 9/1965 | Frisbie et al. | |
| 3,402,503 | A | | 9/1968 | Glass et al. | |
| 3,428,310 | A | * | 2/1969 | Leath | 472/7 |
| 3,481,603 | A | * | 12/1969 | Sugden | 273/271 |
| 3,502,332 | A | * | 3/1970 | Wolf | 463/69 |
| 3,520,475 | A | | 7/1970 | Ernst | |
| 3,579,904 | A | * | 5/1971 | Genin | 238/10 B |
| 3,589,064 | A | * | 6/1971 | Harada | 446/445 |
| 3,594,940 | A | * | 7/1971 | Yonezawa | 446/118 |
| 3,597,858 | A | * | 8/1971 | Ogsbury et al. | 434/72 |
| 3,630,524 | A | | 12/1971 | Cooper et al. | |

(Continued)

OTHER PUBLICATIONS

EIC Search Report, Jul. 26, 2013.*

(Continued)

*Primary Examiner* — Gene Kim
*Assistant Examiner* — Urszula M Cegielnik
(74) *Attorney, Agent, or Firm* — St. Onge Steward Johnston & Reens LLC

(57) ABSTRACT

A toy car race track set comprised of a plurality of easily connectible track sections, in which the track sections have novel provisions for integrating the track sections with structures formed with K'NEX rod and connector elements, including but not limited to structures for elevating track sections above a support or above other track sections, providing obstructions on the race course, and the like. A variety of shapes and forms of track sections enables a substantially limitless variety of track configurations to be assembled. Each section is provided at each end with at least one tongue element and one slot element positioned such that the tongue element of one section is received in the slot of an adjacent section with a desired, snap-in action substantially preventing unintended separation. Optional locking pins are provided for positively locking the track sections to other sections when desired.

5 Claims, 14 Drawing Sheets

(56) References Cited

U.S. PATENT DOCUMENTS

| | | | | | |
|---|---|---|---|---|---|
| 3,712,540 | A | * | 1/1973 | Yamasaki et al. | 238/10 E |
| 3,726,476 | A | * | 4/1973 | Porter et al. | 238/10 E |
| 3,734,404 | A | * | 5/1973 | Baynes et al. | 238/10 E |
| D233,620 | S | * | 11/1974 | Seki | D21/564 |
| 3,896,582 | A | * | 7/1975 | Cohen | 446/85 |
| 3,908,989 | A | * | 9/1975 | Meyer | 273/441 |
| 4,055,019 | A | * | 10/1977 | Harvey | 446/115 |
| 4,117,977 | A | * | 10/1978 | Whitlock | 238/8 |
| 4,148,152 | A | | 4/1979 | Barlow et al. | |
| 4,231,294 | A | * | 11/1980 | Arzoumanian | 104/138.1 |
| 4,231,517 | A | | 11/1980 | Cheng | |
| 4,270,302 | A | * | 6/1981 | Dandia | 446/105 |
| 4,270,748 | A | * | 6/1981 | Ray | 472/116 |
| 4,372,489 | A | | 2/1983 | Lee | |
| 4,423,864 | A | * | 1/1984 | Wiik | 472/91 |
| 4,519,724 | A | * | 5/1985 | Ribas | 403/345 |
| 4,540,119 | A | | 9/1985 | Neuhierl | |
| 4,541,813 | A | * | 9/1985 | Ikeda | 446/424 |
| 4,550,910 | A | * | 11/1985 | Goldfarb et al. | 104/305 |
| 4,571,200 | A | * | 2/1986 | Serna | 446/85 |
| 4,767,053 | A | * | 8/1988 | Cook et al. | 238/10 R |
| 4,826,076 | A | * | 5/1989 | Hesse | 238/10 R |
| 4,861,306 | A | * | 8/1989 | Bolli et al. | 446/90 |
| 4,964,802 | A | * | 10/1990 | Weller | 434/96 |
| 5,199,919 | A | | 4/1993 | Glickman | |
| 5,344,143 | A | * | 9/1994 | Yule | 273/118 R |
| 5,348,478 | A | * | 9/1994 | Bradshaw | 434/150 |
| 5,392,987 | A | | 2/1995 | Ropers et al. | |
| 5,405,080 | A | * | 4/1995 | Yeung et al. | 238/10 F |
| 5,421,762 | A | * | 6/1995 | Glickman | 446/126 |
| 5,451,177 | A | * | 9/1995 | Gilman | 446/128 |
| 5,564,962 | A | | 10/1996 | Navarrete Espinosa | |
| 5,657,695 | A | | 8/1997 | Lanoix et al. | |
| 5,779,515 | A | * | 7/1998 | Chung | 446/90 |
| 5,810,639 | A | * | 9/1998 | Liu | 446/111 |
| 5,873,521 | A | * | 2/1999 | Ernst | 238/10 A |
| 5,888,114 | A | * | 3/1999 | Slocum et al. | 446/128 |
| 5,924,905 | A | * | 7/1999 | Cyrus et al. | 446/118 |
| 5,947,787 | A | * | 9/1999 | Cyrus et al. | 446/127 |
| 5,951,356 | A | * | 9/1999 | Cyrus et al. | 446/118 |
| 5,971,830 | A | * | 10/1999 | Tobin | 446/256 |
| 5,993,283 | A | * | 11/1999 | Cyrus et al. | 446/124 |
| 6,007,401 | A | * | 12/1999 | Cyrus et al. | 446/175 |
| 6,012,957 | A | * | 1/2000 | Cyrus et al. | 446/175 |
| 6,050,044 | A | * | 4/2000 | McIntosh | 52/591.1 |
| 6,068,533 | A | * | 5/2000 | Glickman et al. | 446/111 |
| 6,089,941 | A | * | 7/2000 | Glickman et al. | 446/111 |
| 6,093,079 | A | * | 7/2000 | House | 446/444 |
| 6,102,770 | A | * | 8/2000 | Cyrus et al. | 446/444 |
| 6,227,932 | B1 | * | 5/2001 | Ngai | 446/444 |
| 6,299,072 | B1 | * | 10/2001 | Burns | 238/10 F |
| 6,328,500 | B1 | * | 12/2001 | Rubio | 404/32 |
| D459,007 | S | * | 6/2002 | Campacci | D25/119 |
| 6,581,931 | B1 | * | 6/2003 | Doepner et al. | 273/118 A |
| 6,601,774 | B1 | * | 8/2003 | Kasimoff | 238/10 R |
| 6,647,893 | B1 | * | 11/2003 | Fugitt et al. | 104/69 |
| 7,044,825 | B2 | * | 5/2006 | Glickman et al. | 446/121 |
| 7,267,598 | B2 | * | 9/2007 | Glickman | 446/124 |
| D573,665 | S | * | 7/2008 | Horikoshi | D21/565 |
| 7,666,054 | B2 | * | 2/2010 | Glickman et al. | 446/124 |
| D632,348 | S | * | 2/2011 | McNutt | D21/565 |
| D640,331 | S | * | 6/2011 | Beauregard et al. | D21/565 |
| D651,661 | S | * | 1/2012 | Yuen | D21/565 |
| 8,424,258 | B2 | * | 4/2013 | Modica et al. | 52/285.4 |
| 2006/0207470 | A1 | | 9/2006 | Pfeiffer | |
| 2007/0037479 | A1 | | 2/2007 | Margay | |
| 2007/0057080 | A1 | | 3/2007 | Ngai | |
| 2011/0250822 | A1 | * | 10/2011 | Koehl | 446/444 |

OTHER PUBLICATIONS

International Search Report and Written Opinion of the International Searching Authority; Application No. PCT/US2011/052463; Issued: Jan. 26, 2012; Mailing Date: Feb. 9, 2012; 14 pages.

* cited by examiner

TOY RACE TRACK SYSTEM

CROSS-REFERENCE TO RELATED APPLICATIONS

This application claims the priority of provisional application Ser. No. 61/391,455, filed Oct. 8, 2010, the entire content of which is incorporated herein by reference.

FIELD OF THE INVENTION

This invention relates to multi-part toy race track systems, and more particularly to multi-part toy sets for building race tracks for racing toy vehicles. To advantage, the race track system may be incorporated with elements of a construction toy set to enable the track to be integrated with other structures, providing a virtually limitless variety of combined race track and related structures.

BACKGROUND OF THE INVENTION

Racing of toy racing cars is a popular activity for teen age and pre teen age children and even some adults. A variety of systems are available for this purpose, which include components for assembling race tracks and race cars that are confined by the race track. The race cars are typically electrically driven, either by batteries or by electrical connection with the track assembly. There is a need and desire for a toy race track system which can be easily assembled and disassembled and which accommodates a wide variety of track configurations, including multi-level structures.

SUMMARY OF THE INVENTION

The present invention is directed to an improved, simplified and inexpensive form of toy car racing set, in which individual race track sections of injection molded plastic material can be joined quickly and easily by small children, using a novel snap-together action. The arrangement enables users to quickly assemble a variety of race track configurations, either from provided assembly directions or on a design-it-yourself basis, to provide optimum flexibility in the design and assembly of the race track. Advantageously, each track section is provided at each end thereof with at least one wide, flat tongue element and one tongue-receiving slot of similar shape and dimensions, configured for convenient snap-together joining to secure a pair of adjacent track sections together. The track sections may be provided in single lane sections and multi-lane sections, in which case the sections may be provided at each end with a tongue element and a tongue-receiving slot for each lane of the section. The tongues can be provided with detent barbs at one or both side edges to secure adjacent track sections with a snug, accurately aligned fit. This assures a flat, smooth racing surface for the toy cars.

In an advantageous form of the invention, the track elements may optionally be provided with vertical openings aligned with the tongue-receiving slots thereof, and the tongue elements may also be provided with through openings. The respective openings are so positioned that, when two track sections are assembled in snap-together fashion, the openings in the tongue elements will align with the vertical openings in the track sections. Locking pins can be inserted into said aligned openings, after initial assembly of track sections, to positively lock the sections in assembled relation.

In a preferred form of the invention, track sections can be provided in a wide variety of shapes and widths to accommodate maximum variety in possible configurations of the race track. Importantly, the track sections are designed to interface with the well-known K'NEX rod and connector construction toy sets, such as disclosed in U.S. Pat. No. 5,199,919. This enables structures of considerable complexity to be assembled, involving combinations of race track elements and rod and connector elements to form advantageous hybrid assemblies. In this respect, the track sections are provided on each lateral side with vertically oriented, rod-receiving sockets opening upward and downward and configured for axial snap-in reception of end portions of K'NEX rod elements. The spacing of such sockets, typically in the width direction of the track sections, and in certain cases in the length direction as well, is consistent with the "matrix" of the K'NEX construction toy sets, to enable K'NEX-based sub-assemblies and structures to be joined with track sections, both above and below the track level. The downwardly opening sockets, when joined with downwardly extending K'NEX rods, enable elevation of the track structure with respect to the floor or other supporting surface and also with respect to lower levels of track to accommodate construction of complex multi-level track assemblies, with crossovers and the like.

In one preferred form of the invention, side walls are provided at opposite sides of the track sections for physical confinement of the race cars on the race track surface in normal movement of the race cars along the track. Preferably, the walls are angled outwardly, at a slight obtuse angle to the plane of the race track surface. This facilitates nesting and stacking of track sections in order to optimize the ability to package and store the components. This feature also will allow a race car which is, for example, entering a curved track section at excessive speed, to be ejected from the track. Thus a significant element of skill can be involved in the operation of the race cars, which typically are be battery driven and may be remotely controlled. The track sections preferably also have lower side walls that extend a short distance below the racing surface and support the racing surface above a floor, table or other support.

To advantage, the racing surface formed by the track sections is formed with a large plurality of closely spaced openings (preferably square or rectangular), arranged in a predetermined pattern, to minimize material requirements and reduce the weight of the component parts. The size of the openings is smaller than the width of the wheels of the toy vehicles intended to be run on the track, such that the motion of the vehicles is not affected by the openings.

In accordance with a significant aspect of the invention, the upper side walls are formed with a plurality of integrally formed projections defining vertically oriented sockets for the snap-in reception of the ends of K'NEX rod elements. Alternate ones of the sockets open upwardly and downwardly, such that rod-based structures may be assembled with the track sections, both above and below a racing surface. These integrated structures may be functional or for appearance only. Functional structures may guide and direct cars along the track, present obstacles to be maneuvered around, etc. They also enable racing tracks to be configured in multiple levels, with one level above and/or crossing over another. The structure of the invention accommodates a high degree of ingenuity and imagination on the part of the builders in the configuration of the race tracks and in the incorporation of K'NEX-based structures and components as an integral part thereof.

The invention advantageously is provided in the form of a kit of parts, including a plurality of track sections of various sizes and shapes for assembly of a variety of race courses, and a variety of K'NEX rod and connector elements of various sizes and shapes to enable users to construct a variety of composite structures in which rods and connectors are integrated with assembled track sections.

For a more complete understanding of the above and other features and advantages of the invention, reference should be made to the following detailed description of the invention and to the accompanying drawings.

DETAILED DESCRIPTION OF THE INVENTION

Figure 2:
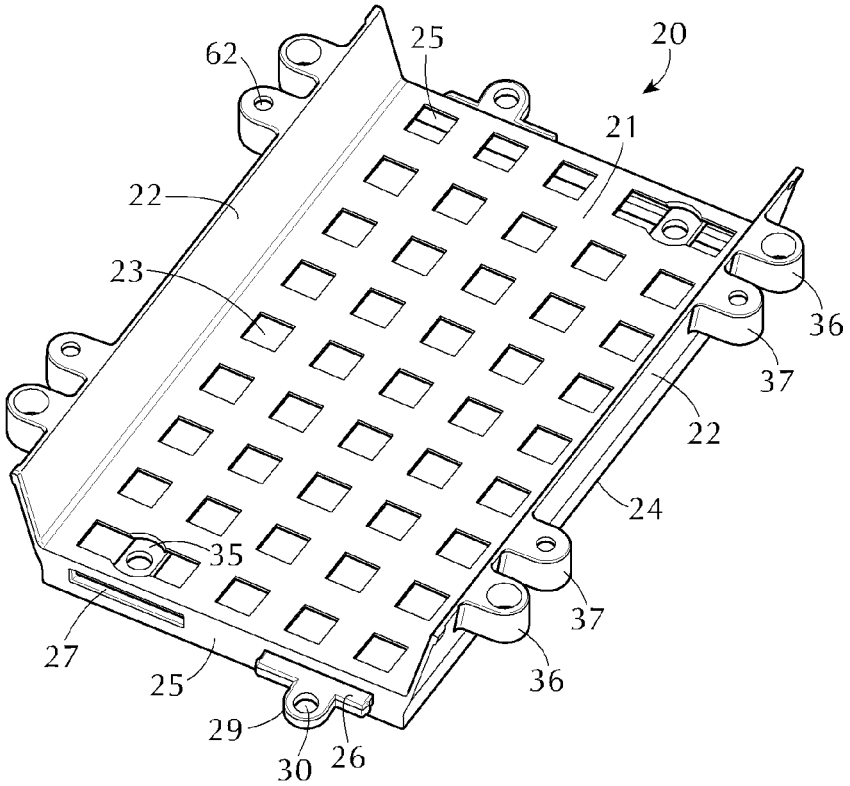
FIG. 2 is an isometric view of a straight, single-lane track section according to the invention.

Referring now to the drawings, the reference numeral 20 (FIG. 2) designates generally a straight, single-lane track section according to the invention. The track section 20 is a one-piece injection molding of plastic material and comprises a flat racing surface 21 and opposite upper side walls 22 extending upward from the side edges of the racing surface. Preferably the side walls are disposed at a slight obtuse angle to the racing surface 21. Among other things, this enables a plurality of like track sections 20 to be nested and stacked for efficient packaging and storage. An angle of about 102° is appropriate for racing purposes and also for nesting purposes. The racing surface preferably is provided with a plurality of surface openings 23, the size and spacing of which are such that toy race cars, designed for operation on the track surface will not be affected by the surface discontinuities. The surface discontinuities serve to reduce the weight of the track section and to minimize the material required for its manufacture. Desirably, the surface openings 23 are of a square shape.

The track sections 20 are also formed with depending lower side walls 24 and end walls 25 which elevate the racing surface 21 somewhat above a support surface (not shown) on which the track section may be placed. At each end, the track section 20 is formed with a flat, horizontal tongue element 26, adjacent one side, and a horizontal slot 27, adjacent the other side. The positions of the tongue 26 and slot 27 are reversed at opposite ends of the track section such that, when two track sections are aligned end to end, the tongue elements 26 of one section align with the slots 27 of the longitudinally adjacent section, enabling the sections to be joined together. The configuration of the tongue elements 26 and slots 27 is such that the slots are slightly smaller in some dimensions than the tongue elements, requiring a degree of force to insert the tongue elements into the slots.

In the illustrated form of the invention, the tongue elements 26 are formed with small, angular detent barbs 28 at their opposite side edges. The outer extremities of the barbs 28 are slightly wider than the slots 27. Accordingly, when two track sections 20 are assembled, the respective tongues 26 have to be somewhat forcibly pressed into the slots with a snap-in action. The plastic material of the track sections is sufficiently deflectable to accommodate the desired snap-in action between tongues and slots. Separating the track sections also requires a firm pull to force the detent barbs 28 back through the slots 27. A pair of track sections thus joined will normally remain joined unless intentionally separated.

Figure 10:
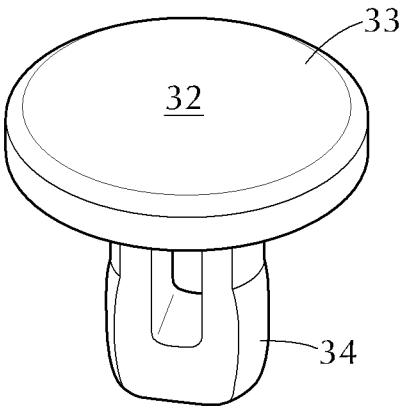
FIG. 10 is an isometric view of a locking pin optionally used to secure joined track sections in a positive manner.

Recognizing that assembled track sections can be subject to unexpected forces, as well as inertial forces from the action of racing cars speeding over the track, a preferred form of the invention includes means for optionally locking adjacent track sections together in a positive manner after the initial snap-in connection. To this end, the tongue elements 26 are provided with a central extension 29 formed with an opening 30. A second opening 31 is provided in the track surface 21, adjacent to and aligned with each of the slots 27. When two track sections 20 are joined, the opening 30 in a tongue element extension 29 will align with an opening 31 in the track surface. A locking pin 32 (FIG. 10), provided with a wide, flat head 33 and a contoured stem 34, is inserted into the aligned openings with a snap-in action of the stem into the openings, to positively lock the adjacent track sections in assembled relation. The track surfaces 21 are formed with circular recesses 35 therein of a size and shape to closely receive the heads 33 of the locking pins, with the upper surfaces of the pins being substantially flush with the surface 21 of the track section.

Figure 14:
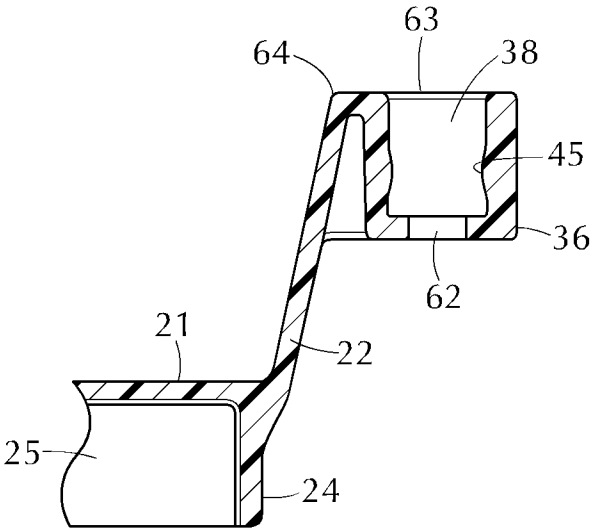
FIGS. 13 and 14 are enlarged, fragmentary cross sectional views taken on lines 13-13 and 14-14 respectively of FIG. 6.
Figure 13:
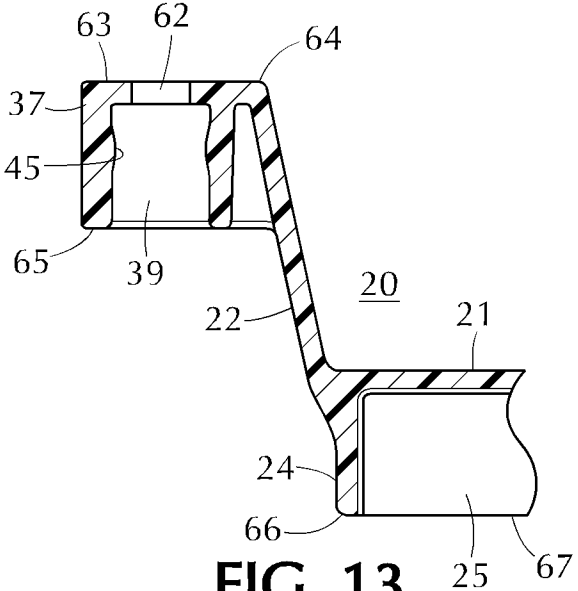
Figure 18:
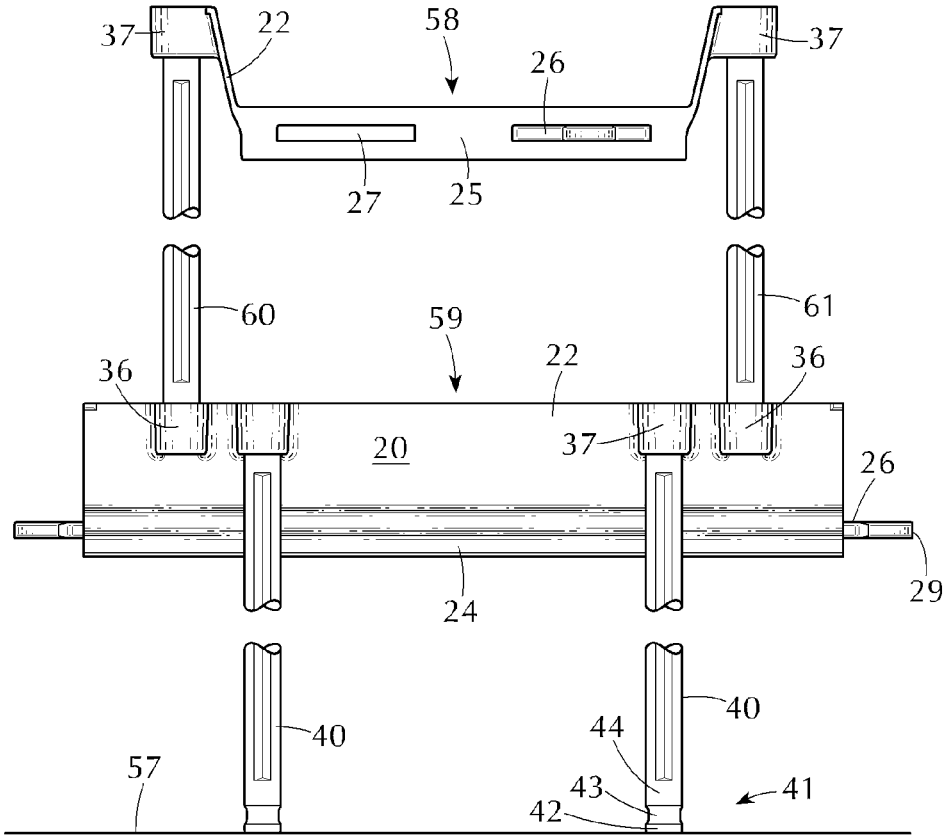
FIG. 18 is an elevational view illustrating two track sections associated with K'NEX rod elements, illustrating the manner in which a track section can be elevated from a support surface and in a crossing fashion from another track section.

In accordance with one aspect of the invention, each of the upper side walls 22 of the track section is provided with a plurality of laterally outwardly extending projections 36, 37 formed integrally with the side walls, preferably in the upper portions thereof. One set of projections 36 is formed with upwardly opening sockets 38, while the other set 37 is formed with downwardly opening sockets 39 (see FIGS. 13, 14). Each of the sockets 38, 39 is vertically oriented and is configured internally for a snap-in reception of an end portion of a standard K'NEX rod of the type shown in, for example, the Glickman U.S. Pat. No. 5,199,919, the content of which is incorporated herein by reference. K'NEX is the registered trademark of K'NEX Limited Partnership Group. Standard K'NEX rods are provided in predetermined lengths according to a progression in which rods of a first length, when joined by connectors to form two sides of an equilateral right triangle, can be connected by a rod of the next larger length in the progression, which forms the hypotenuse of the triangle. The K'NEX rods, examples of which are shown at 40 in FIG. 18, are formed with end portions 41 comprising end flanges 42, annular grooves 43 and cylindrical portions 44. The sockets 38, 39, formed in the projections 36, 37, comprise generally cylindrical openings sized to closely receive end portions 41 of the K'NEX rods. The sockets are provided with internal constriction-forming elements 45, which require the rod to be pushed into the socket with a snap-in action and are positioned to be received in the grooved portion 43 of a rod in order to retain it in the socket against unintended removal.

The projections 36, 37 preferably are positioned with upper surfaces 63 thereof (FIG. 13) substantially level with upper edges 64 of the side walls 22, and with lower surfaces 65 thereof spaced below the upper surfaces 63 by approximately the same distance as the racing surface 21 is elevated above the bottom edges 66, 67 of the lower side walls 24 and end walls 25. Thus, when two or more like track sections are stacked in a nested relation, the lower surfaces 65 of projections 36, 37 of upper nested layers will closely overlie the upper surfaces 63 of projections.

Figure 11:
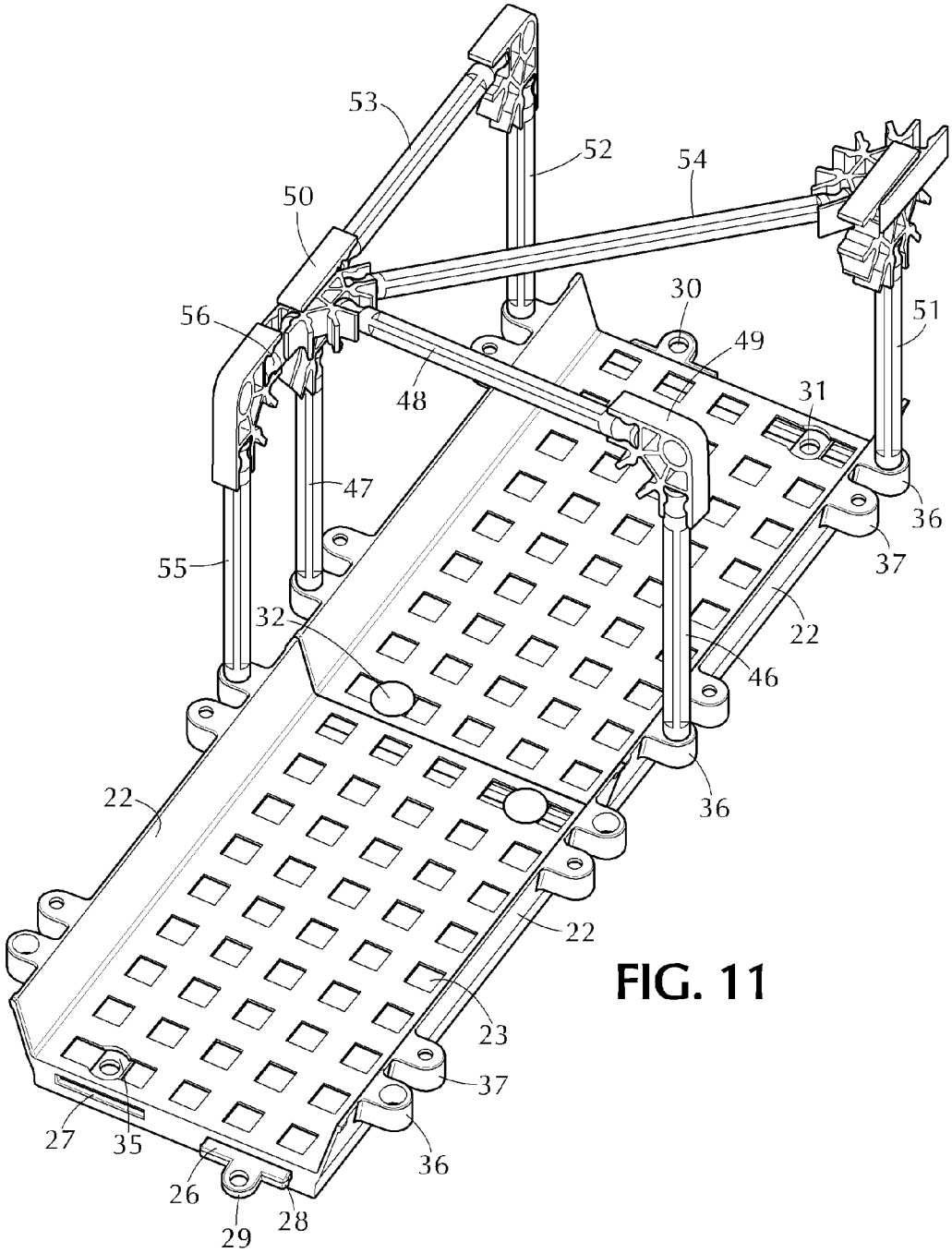
FIG. 11 is an isometric view showing a joined pair of track sections together with an illustrative assembly of K'NEX elements integrated therewith and forming a combined structure.

To advantage the projections 36, 37 and their respective sockets 38, 39 are arranged in transversely opposed pairs. In the illustrated single-lane straight track section 20, there are two opposed pairs of projections 36, with upwardly opening sockets 38, and two opposed pairs 37 with downwardly opening sockets 39. Pursuant to one aspect of the invention, the respective pairs are spaced apart, transversely a distance with coincides with the "matrix" of the K'NEX rods and connectors such that when rods 46, 47 (FIG. 11) are inserted in a pair of transversely opposed sockets 38, the upper ends of the rods can be joined by means of another K'NEX rod 48 using standard K'NEX connector elements 49, 50. Also as a feature of the invention, the longitudinal spacing between upwardly opening sockets 38 on the same side wall 22 corresponds to the transverse spacing between transversely opposed socket pairs. Accordingly, rods 51, 52 inserted into upwardly opening sockets 38 of a second pair of projections 36 can be connected by a rod 53 extending longitudinally between vertical rods 47, 52, and by a rod 54 extending diagonally between rods 47 and 51. Additionally, when two of the track sections 20 are joined, as shown in FIG. 11, upwardly opening sockets 38 of adjacent projections 36 on adjacent track sections are spaced apart according to the same "matrix", such that a rod 55 extending upward from the second track section can be joined with the rod 47 by means of a short K'NEX rod 56 (being of a length according to the described length progression) engaged with standard connectors. In this respect, the length of the track section 20 is itself made according to the K'NEX matrix, so that rod and connector connections can be made between connected track sections as shown in FIG. 11.

In accordance with an aspect of the invention, the longitudinal spacing between an adjacent pair of projections 37 with downwardly opening sockets 39 is also in accordance with the K'NEX matrix previously mentioned, such that rods (not shown) extending downward from a pair If longitudinally adjacent sockets 39 can be joined in the manner exemplified in FIG. 11 by a standard K'NEX rod of a length one size shorter than the rod 53, in the described progression of rod lengths. Accordingly, various support structures may be constructed in conjunction with the track sections 20 to provide elevated track configurations.

As suggested in FIG. 18, the arrangements of upwardly and downwardly opening sockets 38, 39 enables track sections to be elevated with respect to a support surface 57 and also to be elevated from another level of track. In the illustrative arrangement of FIG. 18 an upper track section 58 is supported in elevated and crossing relation to a lower section 59, by means of vertical rods 60, 61 extending between them.

In the illustrated track system, the rod-receiving sockets are designed for reception of so-called "Standard" K'NEX rods. Smaller "Micro" K'NEX rods and connectors may also be integrated with the illustrated track system by utilizing available adapter elements (not shown) having one end sized and configured as a "Standard" rod end and an opposite end sized and configured as a "Micro" rod end. Additionally, the closed ends of the rod sockets 38, 39 may be provided with smaller openings 62 sized such that a "Micro" sized rod may be inserted therein for decorative or other purposes.

Figure 3:
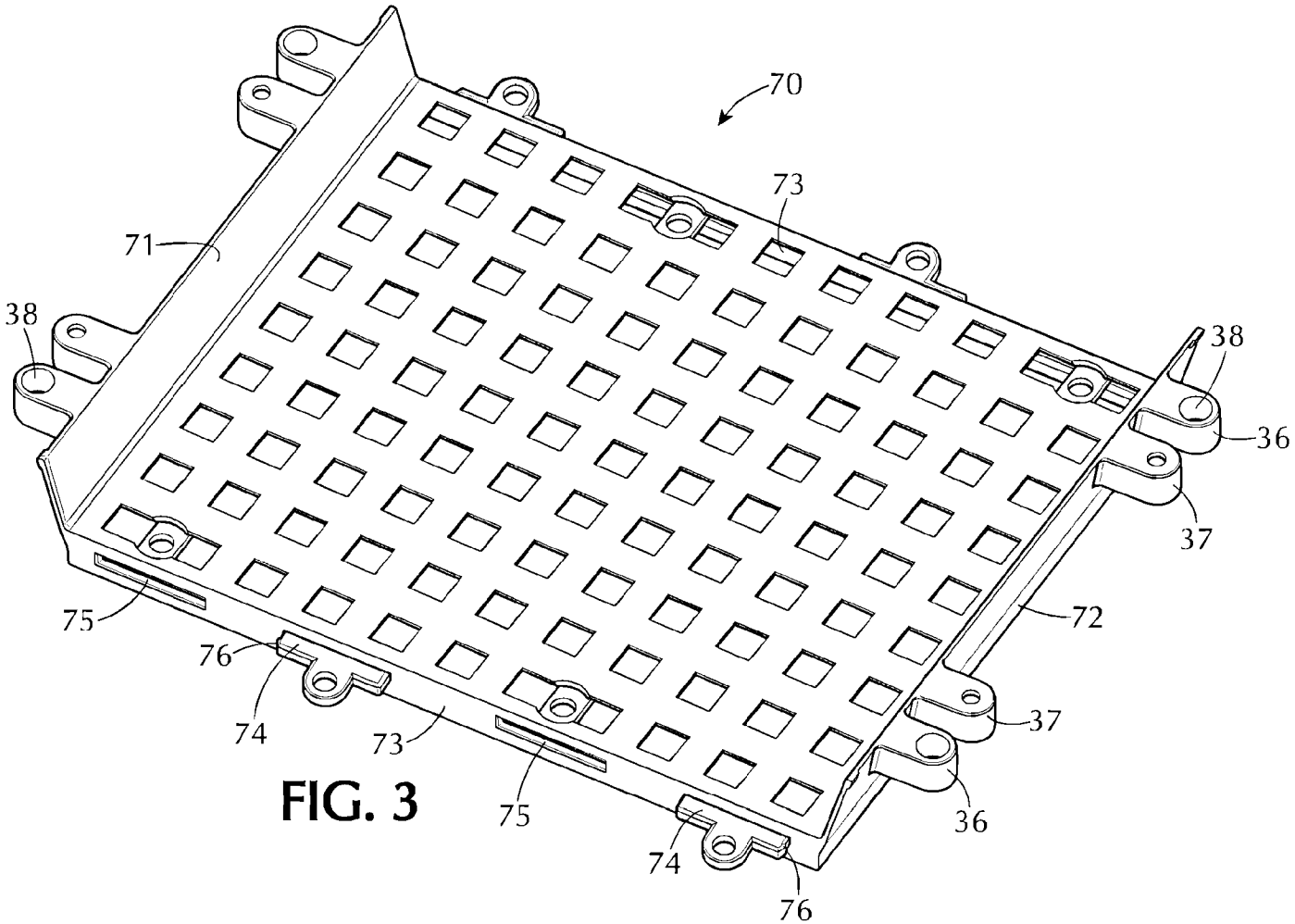
FIG. 3 is an isometric view of a straight, two-lane track section according to the invention.
Figure 8:
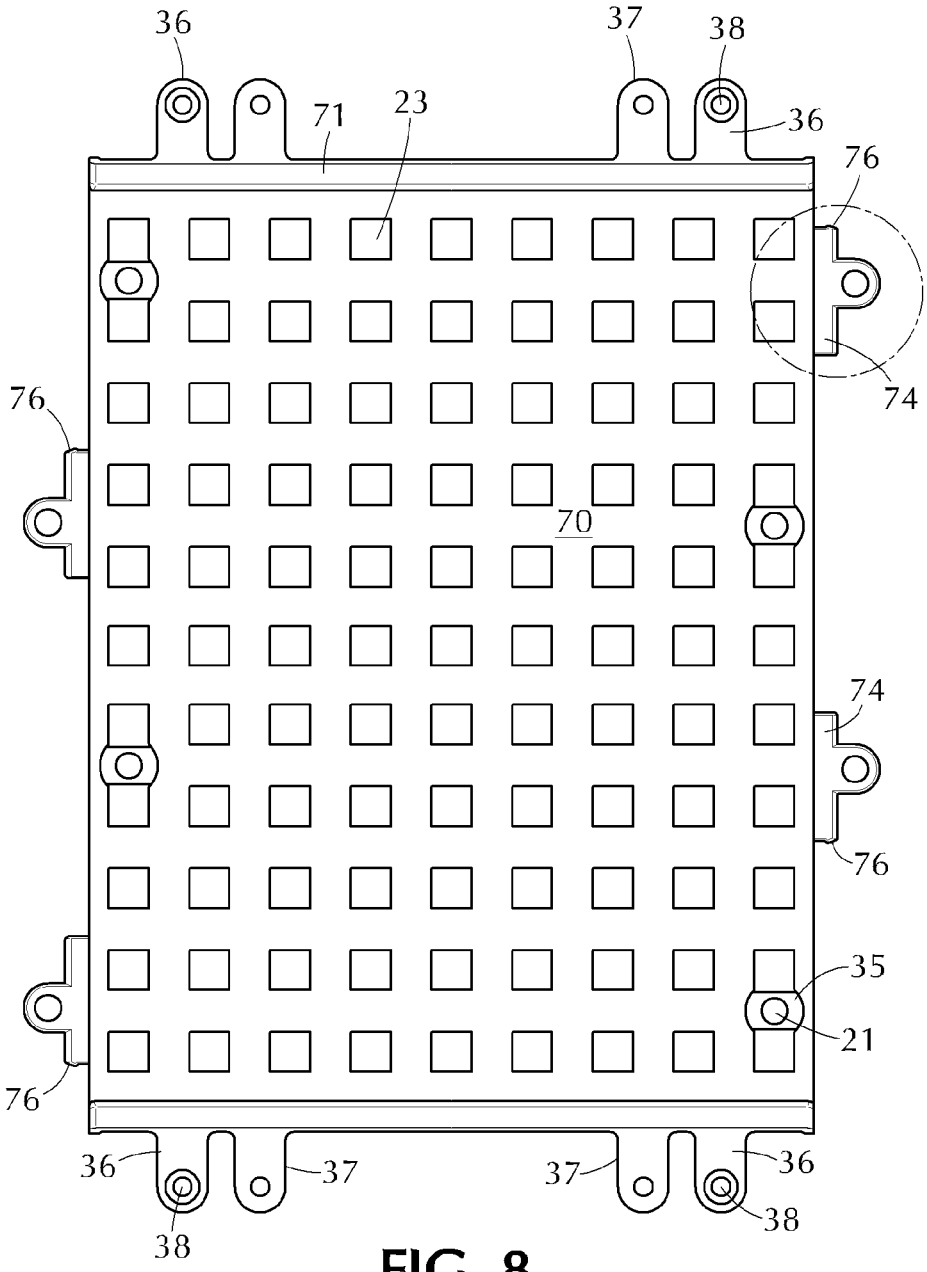
FIG. 8 is a top plan view of the track section of FIG. 3.
Figure 9:
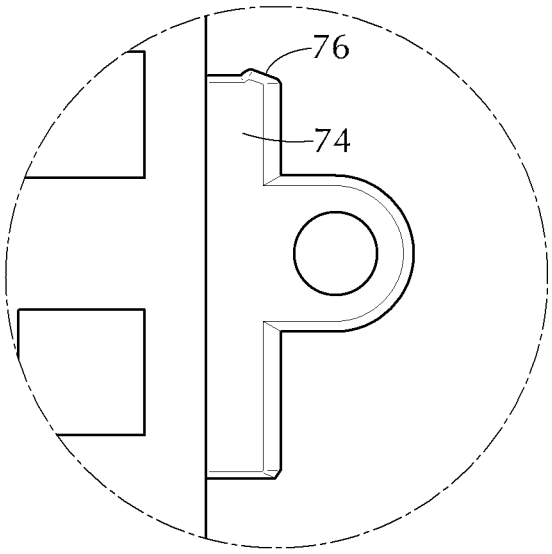
FIG. 9 is an enlarged, fragmentary detail view of the encircled portion of FIG. 8, illustrating an advantageous form of connecting tongue used with two-lane track sections, for joining with other track sections.

Referring now to FIGS. 3, 8 and 9, there is shown a section of straight, two-lane track section 70 according to the invention. The two-lane track section is similar in many respects to the above described single lane track section 20 and similar reference numerals will be employed for convenience when describing common components. The track section 70 advantageously is of the same length as the single-lane section 20 and is provided with transversely opposed pairs of lateral side wall projections 36, 37 formed respectively with upwardly opening and downwardly opening rod-receiving sockets 38, 39. The longitudinal spacing and location of the projections 36, 37 and sockets 38, 39 preferably is the same as for the single-land track section 20, to accommodate the K'NEX matrix and enable integrated structures of K'NEX rods and connectors to be constructed, as exemplified in FIG. 11. The two-lane section 70 is provided with upper and lower side walls 71, 72 corresponding to the side walls 22, 24 of the single lane track 20.

Because of its greater width, the end walls 73 of the track section 70 are provided with two sets of tongues 74 and slots 75 which correspond substantially to the tongues 26 and slots 27 of the single lane track. The tongues 74 are, however, preferentially provided with a detent barb 76 on one side only, as shown in FIG. 9. Because there are two tongues at each end of the track section 70, each tongue has a single detent barb 76, and preferentially the respective barbs are on opposite sides of the tongues, as shown in FIG. 8. Accordingly, when two sections 70 of two-lane width are joined together, the combined force to overcome the detents during assembly and disassembly will be similar to that required for assembly and disassembly of one lane sections, such as the track section 20.

As shown in FIGS. 3 and 8, the racing surface 77 of the two lane section 70 is provided with openings 31 and recesses 35 for the optional reception of locking pins 32, and with a large plurality of small square openings 23 corresponding to those of the single lane track section 20.

Figure 1:
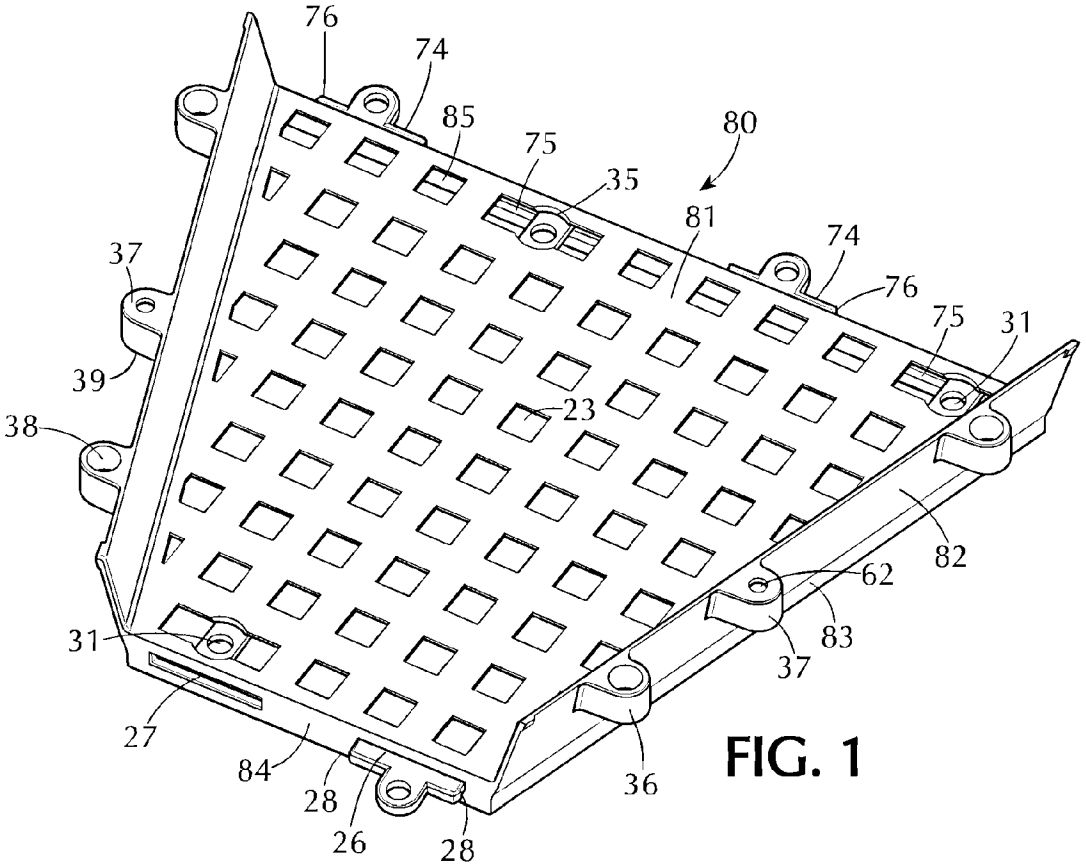
FIG. 1 is an isometric view of a race track section according to the invention in the form of a transition section, being of single-lane width at one end and two-lane width at the other.

FIG. 1 illustrates a transitional track section 80 according to the invention, for joining a single lane track section, such as the section 20, with a two-lane track section, such as the section 70. The transitional section 80 is formed with a tapered racing surface 81, and with upper and lower side walls 82, 83 and end walls 84, 85. At the wide (two-lane) end, the end wall 85 is provided with two tongues 74 and two slots 75, corresponding to the tongues and slots 74, 75 of the two-lane section 70, and at the narrow (one-lane) end, the end wall 84 is formed with a single tongue 26 and slot 27, corresponding to those of the one-lane section 20. The racing surface 81, as in the case of the previously described track sections, is formed with a large plurality of square openings 23, as well as openings 31 and recesses 35 for the reception of locking pins 32.

In accordance with an aspect of the invention, the transitional track section is provided on its upper side walls 82 with spaced apart projections 36 formed with upwardly opening rod-receiving sockets 38 and a single projection 37 in between, formed with a downwardly opening socket 39. The transverse and longitudinal spacing of the projections 36 37 of the transitional track section does not necessary follow closely the K'NEX matrix, because of the tapered form of the side walls. However, the spaced apart projections 36 on each side can be spaced longitudinally in a manner relatively close to the K'NEX matrix to facilitate integration is rod-and-connector assemblies.

Figure 4:
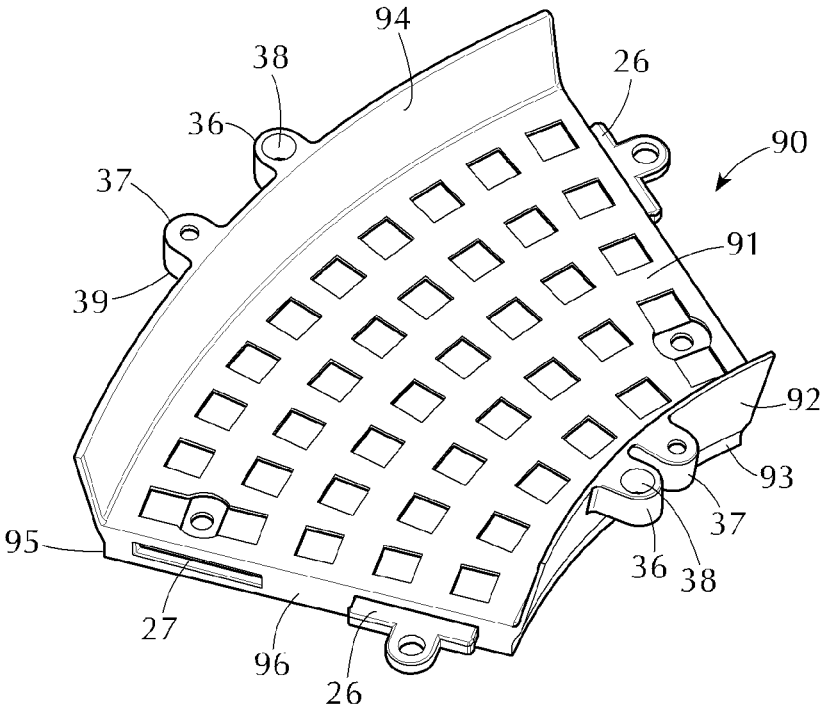
FIG. 4 is an isometric view of a curved, single-lane track section according to the invention.

FIG. 4 illustrates a single-lane curved track section 90 according to the invention. The curved section 90 is similar in many ways to the single-lane straight section 20, although its racing surface 91 and its upper and lower side walls 92, 93 are curved through an arc, preferably of 45 degrees. End walls 94, at opposite ends of the track section, are provided with a single tongue 26 and slot 27, as previously described for the straight track section 20.

On each upper side wall 92 there are projections 36, 37, formed with upwardly and downwardly openings 38, 39 respectively. In the illustrated arrangement, of FIG. 4 the sockets 38, 39 are not paired on a common radius line with another like socket. Instead, each upwardly facing socket 38 is paired on a common radius line with a downwardly facing socket 39. The distance between two upwardly facing sockets (or two downwardly facing sockets) is thus slightly greater than would be dictated by strict adherence to the K'NEX matrix. However, the distance between like-facing sockets 38-38 or 39-39 is sufficiently close to the matrix distance as to be easily accommodated by a slight flexing of rods received in the sockets.

Figure 12:
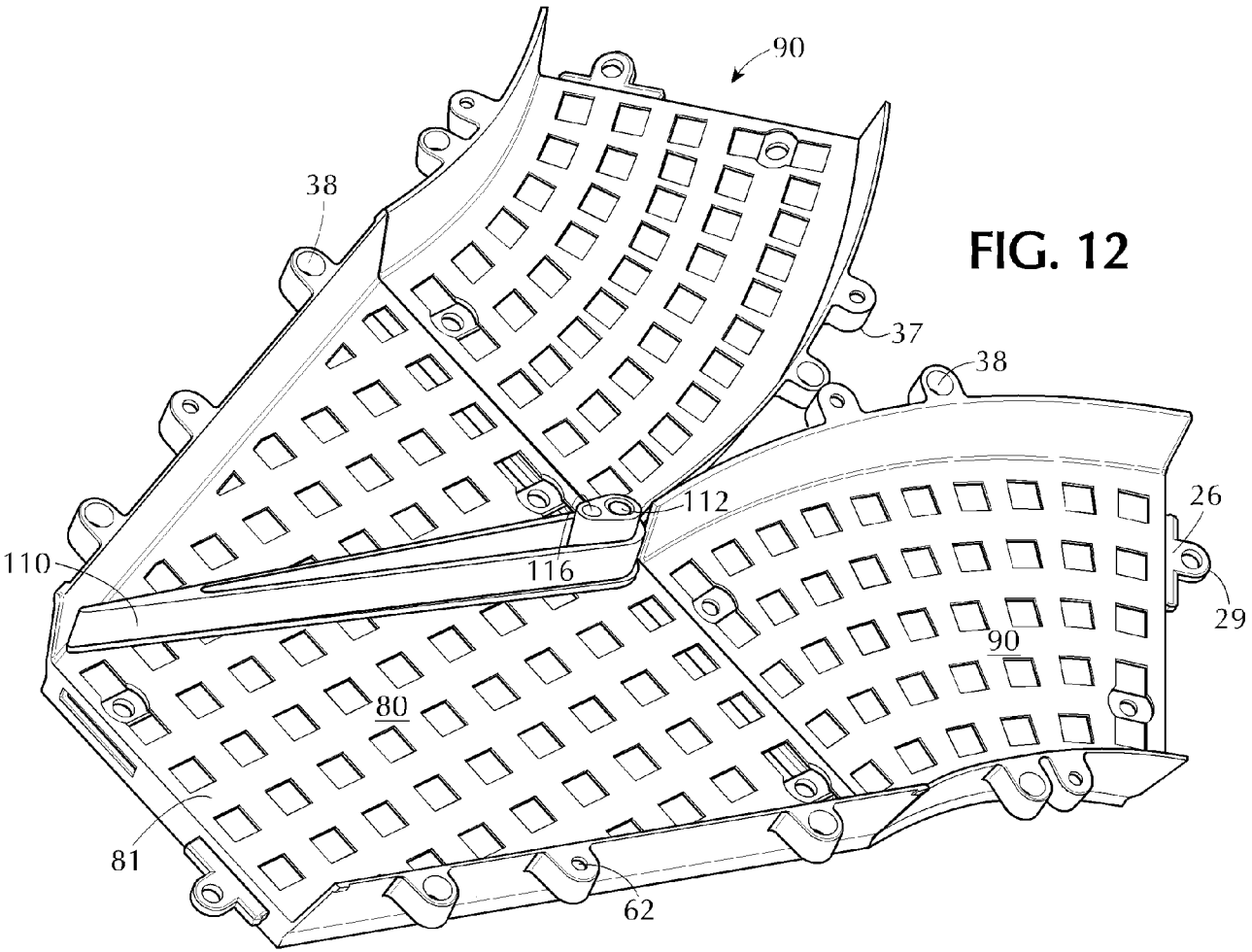
FIG. 12 is an isometric view of a transition track section of FIG. 1 joined at the two-lane end with a pair of single-lane, curved track sections of FIG. 4 and associated with a diverter element for guiding toy vehicles into a selected track.

As can be understood from the illustration of FIG. 4, the curved track sections can be connected to other curved sections 90, either turning in the same direction or turning in the opposite direction is the form of an "S" curve. Also, two of the curved sections 90, oriented to turn in opposite directions, can be connected to the same end of a two-lane straight section 70 or to the two-lane end of a transitional section 80. The latter arrangement is illustrated in FIG. 12.

Figure 5:
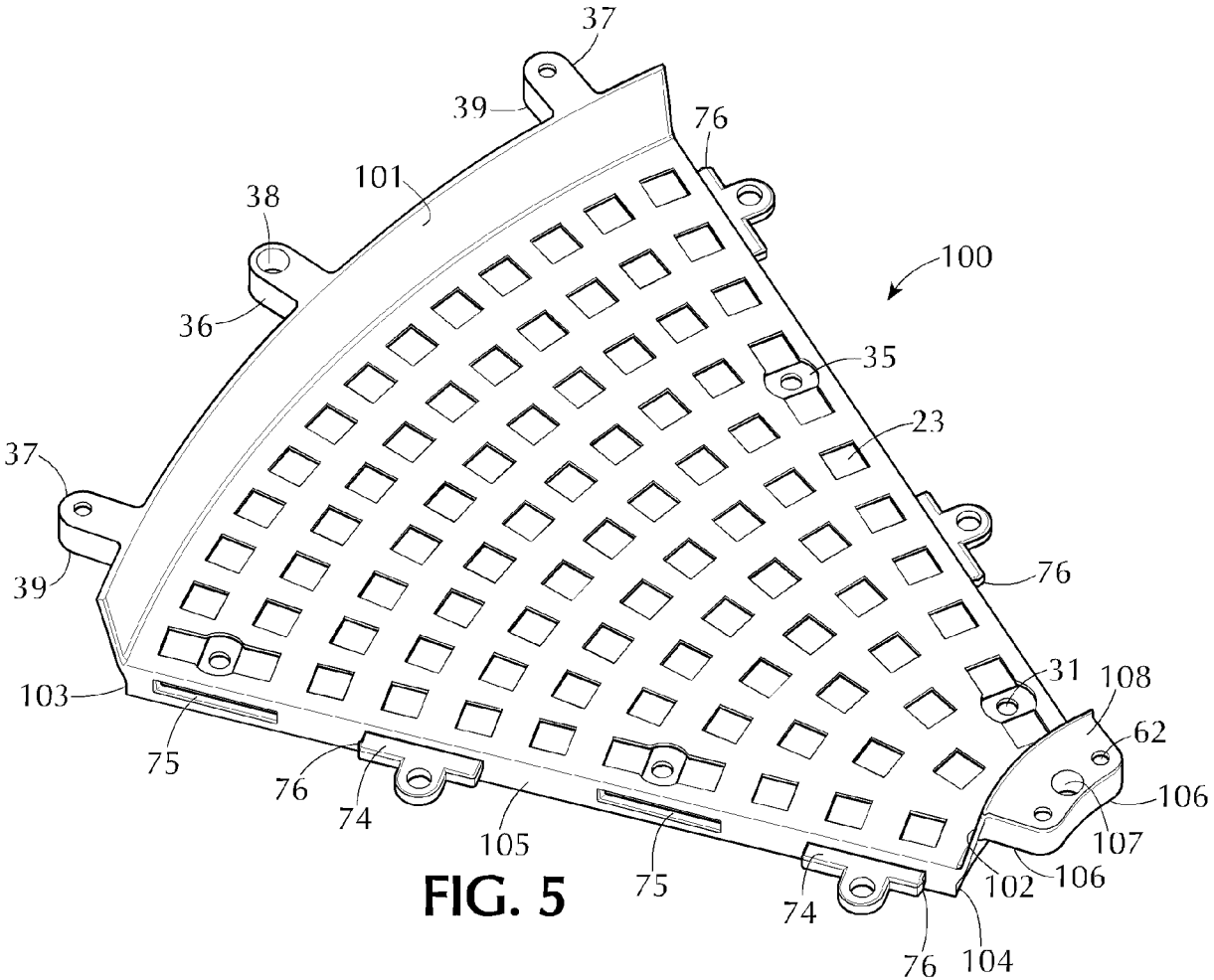
FIG. 5 is an isometric view of a curved, two-lane track section according to the invention.
Figure 7:
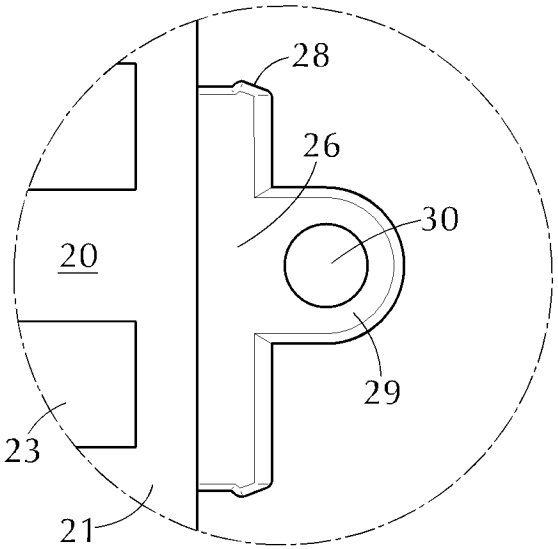
FIG. 7 is an enlarged, fragmentary detail view of the encircled portion of FIG. 6, illustrating an advantageous form of connecting tongue, forming part of the track section of FIG. 6, which is utilized with single-lane track sections for joining with other track sections.
Figure 6:
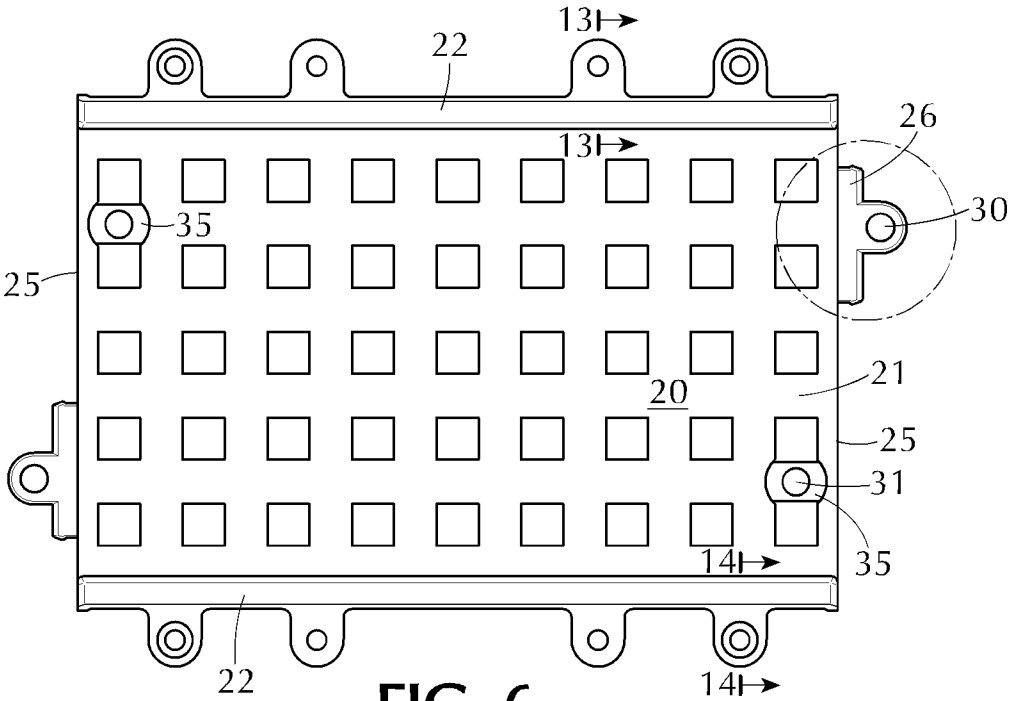
FIG. 6 is a top plan view of the track section of FIG. 2.

In FIG. 5 there is shown a two-lane curved section 100 according to the invention, which has an arc of 45 degrees and has a somewhat pie-shaped configuration. The upper side walls 101, 102 and lower side walls 103, 104 are of arcuate configuration, with the upper side walls being angled outward slightly. End walls 105 are set at a 45 degree angle and extend straight along radius lines from a center of curvature (not shown). The upper side wall 101, on the outside of the curve, is provided with a spaced apart pair of projections 37 formed with downwardly opening rod-receiving recesses 39, and a central projection 36 formed with an upwardly recess 38. In order to position the inner side walls 102, 104 near the center of curvature, these side walls are relatively short. Accordingly, it is advantageous to form a single, relatively large projection 105 extending inward from the side wall 102, in which are formed two downwardly opening recesses 106, and one upwardly opening recess 107. The form and function of the recesses 106, 107 is the same as the recesses 38, 39 previously described.

The end walls 105 of the curved track section 100 are provided with pairs of tongues 74 and slots 75, as for the two-lane section 70, with detent barbs 76 on one side only of the tongues. The various openings 23, 31 and recesses 35 in the racing surface 109 are the same as for the straight two-lane section 70.

Figure 17:
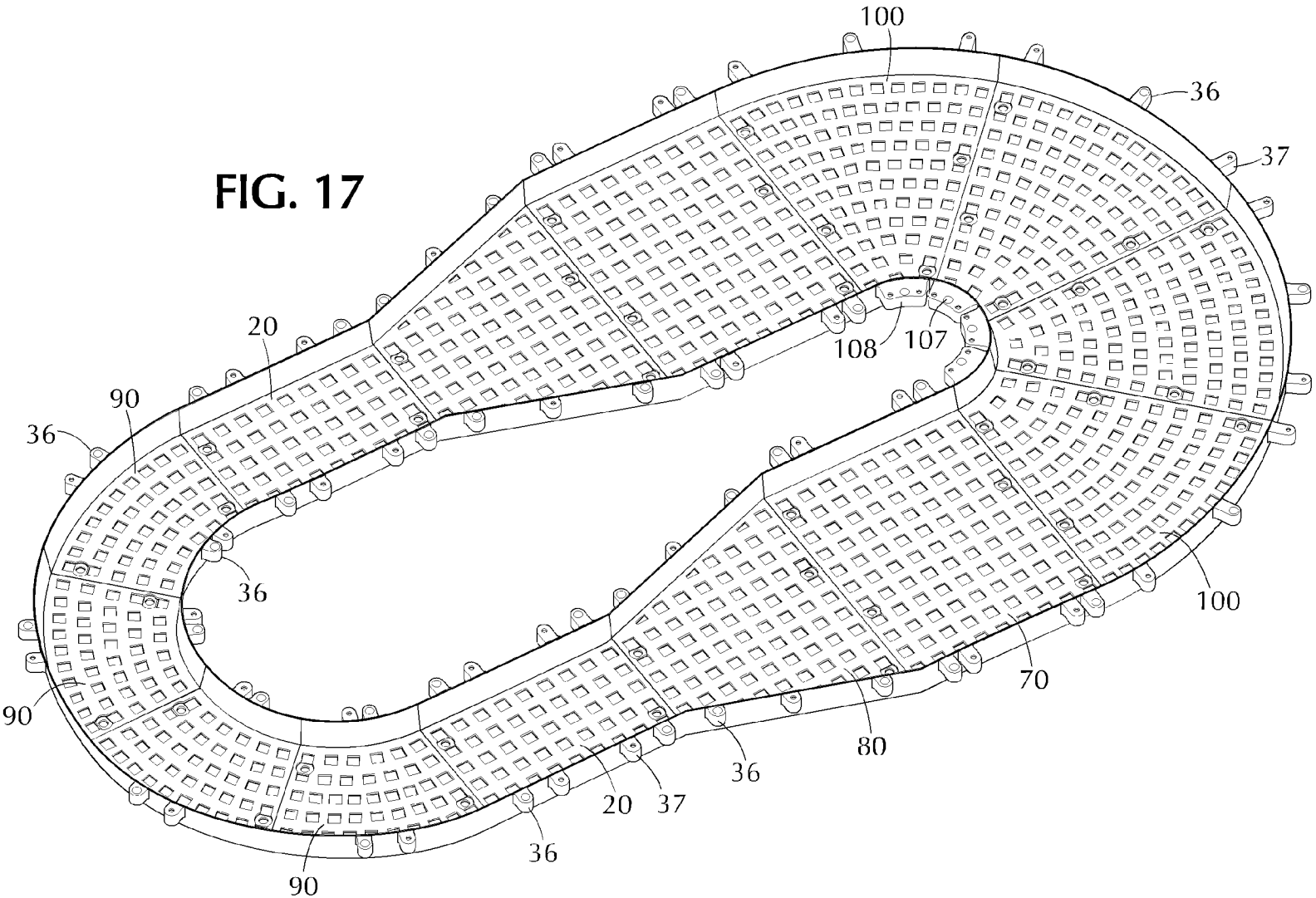
FIG. 17 is an isometric view of a simple, closed track circuit constructed with track sections according to the invention.

FIG. 17 is illustrative of a simple track configuration using the several track components heretofore described. At the left side of the illustration, the track is comprises a pair of one-lane straight track sections 20, joined with four one-lane curved sections 90, assembled in the form of a "U". Joined with the U-shaped track assembly, at each end, are transitional track sections 80, which are connected at their wide ends to sections 70 of two-lane straight track. Four two-lane curved sections 100 are joined to form a semi-circle connected at its opposite ends to the transitional sections 80. This is representative of one of the simplest track configurations. It will be readily understood, however, by those skilled in the art, that the several track sections described can be assembled in an almost limitless variety of track configurations, including elevated and multi-level tracks, crossing configurations, etc. Moreover, as suggested by the number and arrangement of rod-receiving sockets 38, 39 available in even the simple form of track shown in FIG. 17, a similarly virtually limitless variety of K'NEX rod and connector structures may be integrated with a given track configuration, such as providing driving obstacles, decorative structures and the like, limited primarily by the imaginations of the users.

In FIG. 12 there is illustrated a track junction formed by a transitional section 80, which is joined at its wide end by two oppositely turning one-lane curved sections 90. A toy vehicle (not shown) entering the transitional section 80 can exit onto either of the two curved sections and thereby sent on a selected course. In order to guide the vehicle to the desired exit lane, a diverter element 110 is provided, which can be positioned as shown in FIG. 12 to guide a vehicle alternatively to the left or the right into a selected exit lane. The diverter 110 is of elongated, tapered configuration, approximately as long as the transitional section 80. At its larger end the diverter is provided with a downwardly opening pin socket 111 (FIG. 16), of a size to receive the stem 34 of a pin 32. In the FIG. 12 arrangement, the pin is inserted upwardly, from below the racing surface 81, through a center square opening at the wide end of the transitional element 80 and into the pin socket 111 to provide a pivot mounting for the diverter.

When the narrow end of the diverter 110 is pivoted to the left, as shown in FIG. 12, any vehicle entering the transitional section from the one-lane side is diverted to the right into the exit lane formed by the right side curved section. A vehicle approaching in the opposite direction, from the left side curved section onto the transitional section, will engage the diverter and cause it to be pivoted to the opposite side.

Figure 16:
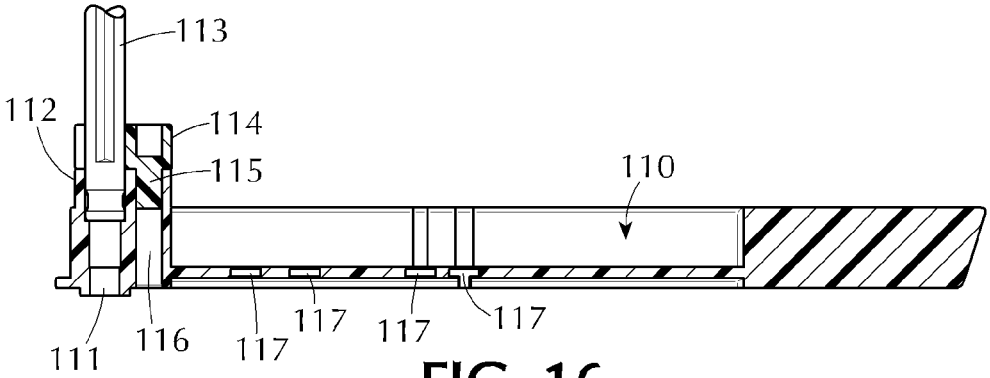
FIG. 16 is a longitudinal cross sectional view of a diverter element shown in FIG. 12.

As shown in FIG. 16, the diverter element 110 is provided at its pivot end with a rod-receiving socket 112 adapted for the snap-in reception of a K'NEX rod 113. The rod socket 112 preferably aligned with the pin socket 111 so as to be aligned with the pivot axis of the diverter. A clip element 114, which can be snapped laterally onto the rod 113, has an integral pin 115 which is received in an upwardly opening recess 116 in the diverter. The arrangement is such that, when the clip is attached, the rod 113 is fixed to the diverter for rotation therewith. This allows actuating elements (not shown) to be attached to the rod 113 and to extend forward therefrom (i.e., to the right in FIG. 12 and to the left in FIG. 16. Such actuating elements can be positioned to be engaged by a vehicle diverted onto one of the curved exit lanes whereby an exiting vehicle flips the diverter to the opposite side. Alternate vehicles moving from left to right on the track assembly of FIG. 12 will thus be directed alternately to the right exit lane and to the left exit lane. Within the ambit of one skilled in the art, a variety of arrangements can be provided for actuating the diverter element 110, either manually or automatically by the vehicles or by other elements integrated into the track system.

As shown in FIG. 16, the diverter 110 may be provided in its bottom wall with a plurality of openings 117 of a size to receive a pin stem 34. These openings 117, together with the pin socket 111 provide options for securing the diverter in a fixed manner to a track section, as an obstacle or barrier or simply as a fixed diverter, as the user may desire.

Figure 15:
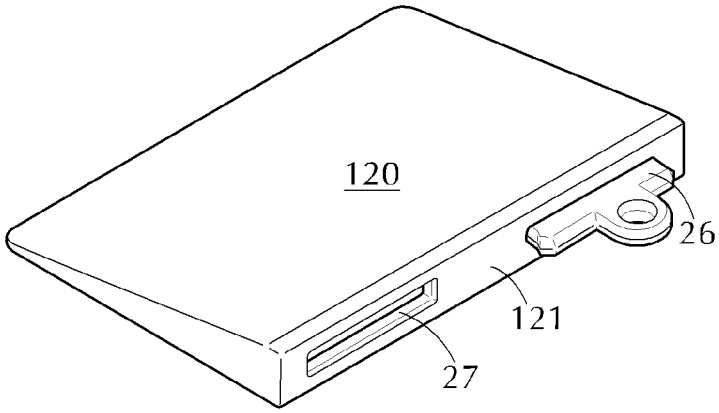
FIG. 15 is an isometric view of a ramp section to facilitate entry of toy vehicles onto the racing surfaces.

FIG. 15 shows a ramp accessory 120, which can be usefully incorporated into various track systems, to facilitate the entry or exit of toy vehicles from (or back onto) a floor or other support surface. The illustrated ramp is of single-lane width and of rectangular shape. The ramp has an end wall 121 at one end formed with a tongue 26 and slot 27 and adapted for snap-in connection with any of the heretofore described track elements. The opposite end 122 of the ramp is relatively thin, such that wheels of a toy racing car can easily enter onto or exit from the ramp while driving onto or off of a track assembly. By way of example, the ramp 120 could be connected to the narrow end of the transitional track section 80 shown in FIG. 12, enabling a race car to enter onto or exit from either of the track systems provided by the two curved sections 90 and the diverter element 110.

It is apparent that the toy race track system of the invention, particularly when integrated with elements of a K'NEX rod and connector set, provides a relatively unlimited variety of construction and racing options to the user. The individual track sections can simply be plugged together with a snap-in action, such that an extensive and complicated track configuration can be quickly assembled and put into operation. Integration with K'NEX rod and connector elements enables the track to have multiple levels, crossovers and the like, as well as various obstacles and hindrances. The rod and connector elements may also be incorporated to form related structures, such as bridges, overhead structures, etc., and also for automatic operation of diverter elements as described.

It should be understood, of course, that the specific embodiments of the invention herein illustrated and described are intended to be representative, but not limiting, of the invention, as various changes and modifications thereof may be made without departing from the principles of the invention. Accordingly, reference should be made to the following appended claims in determining the full scope of the invention.

What is claimed is:

1. A kit of parts comprising a plurality of race track sections for toy vehicles, wherein said track sections are each comprised of a one-piece molding of plastic material and comprise a substantially flat racing surface having first and second ends and opposite side edges, end wall sections integrally formed with and extending downward from each of said first and second ends, and lower side wall sections integrally formed with and extending downward from each of said opposite side edges, at least certain of said end wall sections and said lower side wall sections being functional to support said racing surface above an external support surface, upper side wall sections integrally formed with and extending upward from said opposite side edges at an obtuse angle with respect to said flat racing surface, each of said upper side wall sections having one or more integrally formed projections extending laterally outward from outer surfaces thereof, said projections having vertically oriented rod-receiving sockets therein for the optional acceptance and retention of vertically oriented rod elements, said kit of parts further including:

a plurality of connector elements characterized by having a central hub and one or more rod-end receiving sockets disposed radially with respect to said hub and comprised of an end wall and spaced apart gripping arms extending from the end wall, said gripping arms having longitudinally grooved outer portions engageable with rod end portions and transverse ribs between said grooved outer portions and said end wall, the end walls of said connector element sockets being uniformly spaced radially with respect to an axial center of said central hub, a plurality of rod elements each having end portions comprised of an end flange arranged to seat against an end wall of a connector element socket, an annular groove adjacent to and partly defining said end flange and engageable by transverse ribs of a connector element, and portions adjacent to said annular groove engageable by said grooved outer portions of said connector element gripping arms, said plurality of rods having a predetermined length progression such that, when two rods of length $L_x$ are engaged in a connector element joining them at right angles to each other, they can be joined by a rod of the next longer length $L_{(x+1)}$, serving as a hypotenuse, by connectors engaging the two rods of length $L_x$, at least certain of the vertically oriented rod-receiving sockets of said track sections being spaced apart in accordance with a spacing matrix defined by said rod and connector elements, whereby rod and connector structures may be integrated with track assemblies.

2. A kit of parts according to claim 1, wherein the spacing between an opposed set of rod sockets on opposite upper side wall sections of at least certain of said track sections is such that two vertically extending rods, engaged by first ends thereof in said rod-receiving sockets of said track sections can be joined at second ends thereof by a pair of connectors engaged with said second ends thereof and with a rod element extending between said pair of connectors.

3. A kit of parts according to claim 1, wherein said plurality of track sections include one or more track sections having a track portion of two-lane width, and at least two track sections of single-lane width joinable in side-by-side relation with said track portion of two-lane width, and further including a diverter element having a downwardly opening recess at one end for pivotal mounting of said diverter element on said track portion of two-lane width, said diverter element, when so mounted, being pivotally movable from one side to the other for diverting vehicles moving on said two-lane track portion onto a selected side thereof and onto a selected one of said track sections of single-lane width.

4. A kit of parts according to claim 3, wherein, said diverter element has an upwardly opening rod-receiving socket, aligned with said recess, for reception of a vehicle-engaging pivot mechanism.

5. A kit of parts according to claim 1, wherein said end wall sections of said track sections each have at least one transversely elongated rectangular slot therein and at least one integral, longitudinally projecting tongue, and said tongues have transversely elongated, rectangular cross sections corresponding substantially to the size and shape of the rectangular slots such that, when two track sections are assembled in end-to-end, the tongue of each track section is received closely within the slot of the other track section with a snap action to retain said track sections in assembled relation, and further including a ramp section of tapered configuration having an elevated end and a non-elevated end, said elevated end having an end wall section corresponding to the end wall sections of said track sections and having a transversely elongated rectangular slot therein and an integral longitudinally projecting tongue, said ramp section being engageable with an end wall section of one of said track sections to accommodate transfer of a toy vehicle from the level of a support surface to the level of the racing surface of said one of said track sections.

* * * * *